US011117159B2

(12) United States Patent
Williams

(10) Patent No.: US 11,117,159 B2
(45) Date of Patent: Sep. 14, 2021

(54) ADAPTER FOR HOT-MELT ADHESIVE DISPENSER AND SYSTEM INCLUDING THE SAME

(71) Applicant: Altria Client Services LLC, Richmond, VA (US)

(72) Inventor: Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 16/792,370

(22) Filed: Feb. 17, 2020

(65) Prior Publication Data

US 2021/0252549 A1 Aug. 19, 2021

(51) Int. Cl.
*B05C 11/10* (2006.01)

(52) U.S. Cl.
CPC ..... *B05C 11/1042* (2013.01)

(58) Field of Classification Search
CPC ..... B05C 11/1042; B05C 5/001; B05C 17/00526; B05C 17/00546; B67D 7/80; B67D 7/82
See application file for complete search history.

(56) References Cited

U.S. PATENT DOCUMENTS 5,665,067 A 9/1997 Linder et al.
6,296,463 B1 * 10/2001 Allen ..... B05B 7/0807 118/315
6,499,629 B1 * 12/2002 Colangelo ..... B05C 5/001 222/146.5
8,276,611 B2 10/2012 Swab et al.
9,242,846 B2 1/2016 Burns
9,573,159 B2 2/2017 McGuffey
9,731,332 B1 8/2017 Smith et al.
2001/0000611 A1 * 5/2001 Cline ..... B05B 7/32 222/1
2004/0159672 A1 * 8/2004 Auber ..... B05C 5/0225 222/1
2005/0230423 A1 * 10/2005 Riney ..... B05C 5/001 222/146.2
2007/0071903 A1 * 3/2007 Claar ..... B05D 7/00 427/421.1
2010/0230516 A1 * 9/2010 Solie ..... B01F 5/0614 239/428
2011/0121034 A1 5/2011 Swab et al.

FOREIGN PATENT DOCUMENTS

CN 107470096 A 12/2017

* cited by examiner

*Primary Examiner* — Vishal Pancholi
(74) *Attorney, Agent, or Firm* — Harness, Dickey & Pierce, P.L.C.

(57) ABSTRACT

An adapter is configured to be mounted onto or otherwise coupled to a hot-melt adhesive dispenser. The adapter may include a body defining at least a first inlet channel, a second inlet channel, and a feed channel. The first inlet channel is configured to receive a first adhesive. The second inlet channel is configured to receive a second adhesive. The feed channel is configured to direct at least one of the first adhesive or the second adhesive to the hot-melt adhesive dispenser.

19 Claims, 13 Drawing Sheets

ADAPTER FOR HOT-MELT ADHESIVE DISPENSER AND SYSTEM INCLUDING THE SAME

BACKGROUND

Field

The present disclosure relates to dispensers and systems for supplying hot-melt adhesives (HMA).

Description of Related Art

Generally, a hot-melt adhesive dispenser includes an internal heating element and is configured to receive a solid adhesive (e.g., cylindrical stick of thermoplastic adhesive) which is melted by the internal heating element. The solid adhesive may be pushed through the hot-melt adhesive dispenser via a mechanical trigger mechanism or via direct finger pressure so as to be squeezed out of the nozzle.

SUMMARY

At least one embodiment relates to an adapter for a hot-melt adhesive dispenser.

In an example embodiment, an adapter for a hot-melt adhesive dispenser may include a body defining at least a first inlet channel, a second inlet channel, and a feed channel. The first inlet channel is configured to receive a first adhesive. The second inlet channel is configured to receive a second adhesive. The feed channel is configured to direct at least one of the first adhesive or the second adhesive to the hot-melt adhesive dispenser.

At least one embodiment relates to a hot-melt adhesive dispensing system.

In an example embodiment, a hot-melt adhesive dispensing system may include a hot-melt adhesive dispenser and an adapter connected to the hot-melt adhesive dispenser. The hot-melt adhesive dispenser defines an adhesive inlet, an adhesive chamber, and an adhesive outlet. The hot-melt adhesive dispenser includes a heater configured to heat the adhesive chamber. The adapter includes a body defining at least a first inlet channel, a second inlet channel, and a feed channel. The first inlet channel is configured to receive a first adhesive. The second inlet channel is configured to receive a second adhesive. The feed channel is configured to direct at least one of the first adhesive or the second adhesive to the adhesive inlet of the hot-melt adhesive dispenser.

At least one embodiment relates to a method of dispensing a hot-melt adhesive.

In an example embodiment, a method of dispensing a hot-melt adhesive may include mounting an adapter onto a hot-melt adhesive dispenser. The adapter may include a body defining at least a first inlet channel, a second inlet channel, and a feed channel. The first inlet channel is configured to receive a first adhesive. The second inlet channel is configured to receive a second adhesive. The feed channel is configured to direct at least one of the first adhesive or the second adhesive to the hot-melt adhesive dispenser. The method may additionally include supplying the first adhesive or the second adhesive to the hot-melt adhesive dispenser via the adapter. The method may further include conductively heating the adapter while the first adhesive or the second adhesive is being directed through the body to the hot-melt adhesive dispenser.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
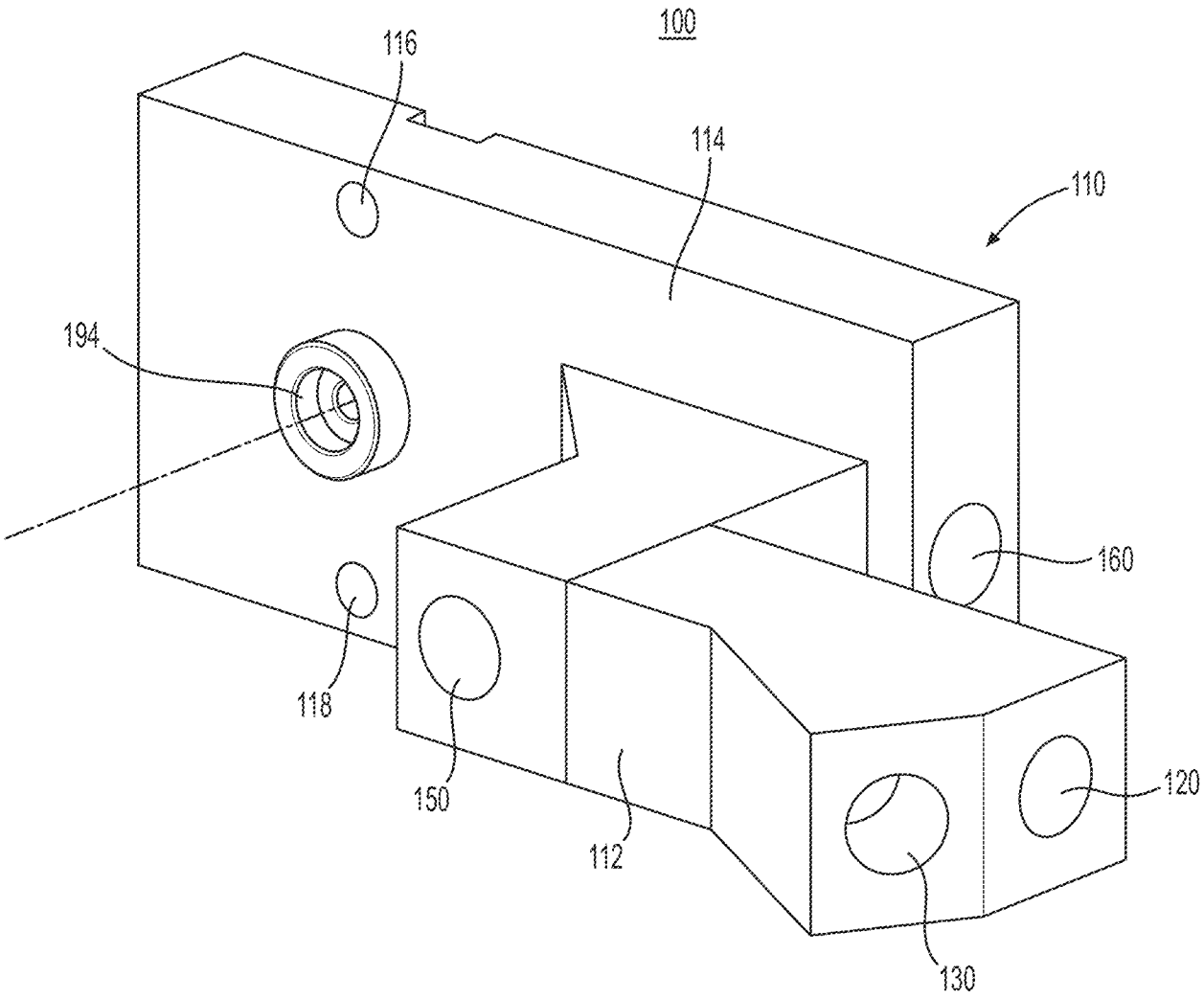
FIG. 1 is an upper proximal, dispenser-side perspective view of an adapter for a hot-melt adhesive dispenser according to an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," "attached to," "adjacent to," "covering," etc. another element or layer, it may be directly on, connected to, coupled to, attached to, adjacent to, covering, etc. the other element or layer or intervening elements or layers may be present. In contrast, when an element is referred to as being "directly on," "directly connected to," "directly coupled to," etc. another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is an upper proximal, dispenser-side perspective view of an adapter for a hot-melt adhesive dispenser according to an example embodiment. Referring to FIG. 1, an adapter 100 is configured to be mounted onto (or otherwise coupled to) a hot-melt adhesive dispenser. For instance, the adapter 100 may be supported by the hot-melt adhesive dispenser. The hot-melt adhesive dispenser may be one that is used to dispense a hot-melt adhesive in connection with the manufacturing of cigarettes (e.g., manufacturing of filters for cigarettes), although example embodiments are not limited thereto. The adapter 100 increases the number of adhesive supply lines that can be connected to the hot-melt adhesive dispenser. In particular, with regard to a hot-melt adhesive dispenser that is originally designed to handle only one adhesive supply line at a time, the adapter 100 enables several different adhesive supply lines to be connected to the hot-melt adhesive dispenser. As a result of the adapter 100, switching between different adhesives for the hot-melt adhesive dispenser can be achieved in a relatively simple and expedited manner, thereby decreasing process downtime. As used herein, the hot-melt adhesive may be referred to as hot glue, and the hot-melt adhesive dispenser may be referred to as a glue gun.

The adapter 100 includes a body 110 defining a plurality of channels configured to receive and transport adhesives therethrough. Additionally, the adapter 100 is configured to heat the adhesive being transported through the body 110 to the hot-melt adhesive dispenser. In an example embodiment, the body 110 of the adapter 100 is a monolithic structure. The body 110 of the adapter 100 may also be formed of a conductive material. The conductive material may be a metal or a metal alloy. The metal or metal alloy may include copper and/or zinc (e.g., brass).

Figure 11:
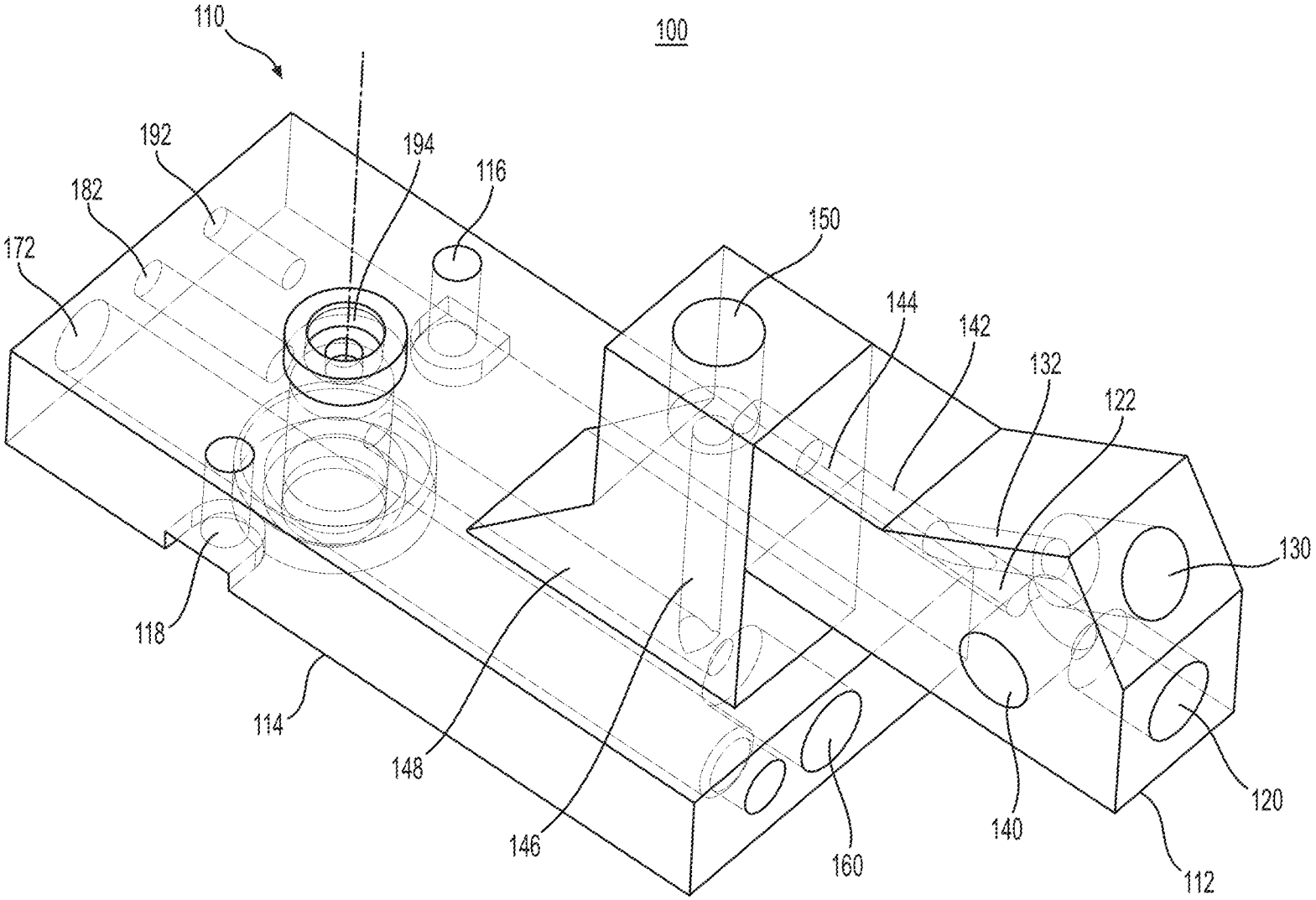
FIG. 11 is a dispenser-side transparent view of the adapter of FIG. 1.
Figure 12:
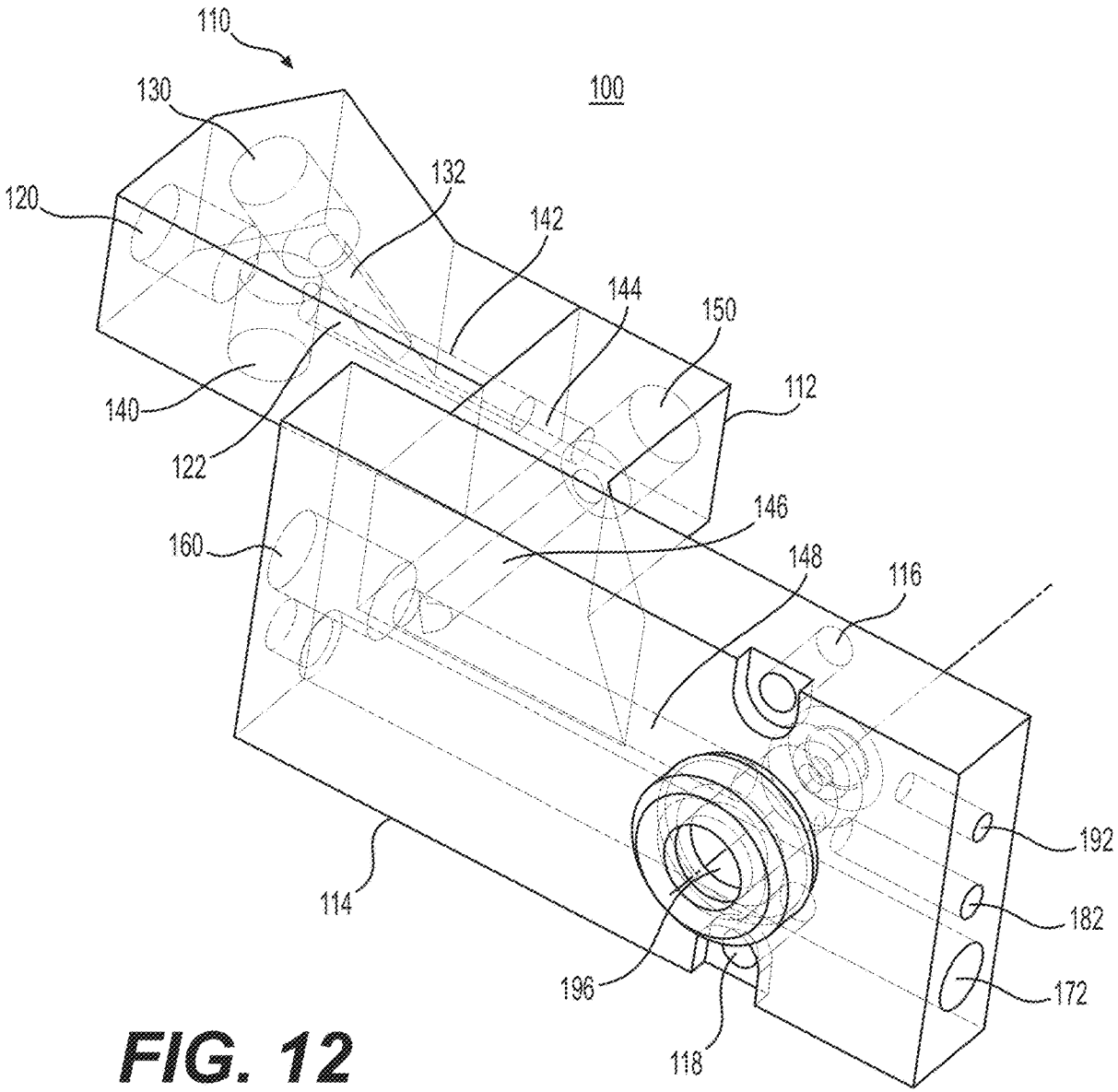
FIG. 12 is a nozzle-side transparent view of the adapter of FIG. 1.

The entrances to the channels within the body 110 of the adapter 100 may be in the form of ports. As illustrated in the drawings, the diameter of each port may be larger than the diameter of the channel associated therewith. The first port 120, the second port 130, the fourth port 150, and the fifth port 160 are shown in FIG. 1, while the third port 140 is shown, for instance, in FIG. 3. The first port 120 is an entrance (or access point) to the first inlet channel 122 (FIGS. 11-12). The second port 130 is an entrance (or access point) to the second inlet channel 132 (FIGS. 11-12). The third port 140 is another entrance (or access point) to the first inlet channel 122 (FIGS. 11-12). The fourth port 150 is an entrance (or access point) to the second feed segment 146 of the feed channel 142 (FIGS. 11-12). The fifth port 160 is an entrance (or access point) to the third feed segment 148 of the feed channel 142 (FIGS. 11-12). As noted above, the first inlet channel 122, the second inlet channel 132, and the feed channel 142 (with its various segments) are illustrated in FIGS. 11-12 and will be subsequently discussed in connection therewith.

The adhesive supply lines are connected to the adapter 100 via various combinations of the first port 120, the second port 130, the third port 140 (e.g., FIG. 3), the fourth port 150, and/or the fifth port 160. In an example embodiment, two adhesive supply lines may be connected to two corresponding ports of the adapter 100, while the other unused/unconnected ports may be plugged or otherwise sealed. For instance, one adhesive supply line may be connected to the first port 120, and another adhesive supply line may be connected to the second port 130, while the third port 140, the fourth port 150, and the fifth port 160 are plugged. In another instance, one adhesive supply line may be connected to the first port 120, and another adhesive supply line may be connected to the third port 140, while the second port 130, the fourth port 150, and the fifth port 160 are plugged. In a further instance, one adhesive supply line may be connected to the second port 130, and another adhesive supply line may be connected to the third port 140, while the first port 120, the fourth port 150, and the fifth port 160 are plugged. However, it should be understood that other combinations are possible. In particular, when space permits (e.g., based on existing equipment), more than two adhesive supply lines (e.g., three, four, or five) may be connected to various combinations of the first port 120, the second port 130, the third port 140, the fourth port 150, and/or the fifth port 160.

The body 110 of the adapter 100 may be regarded as having a base portion 114 and a neck portion 112 extending or projecting from the base portion 114. In an example embodiment, the base portion 114 is integrally formed with the neck portion 112 such that the body 110 of the adapter 100 is a monolithic structure. Alternatively, the base portion 114 and the neck portion 112 may be separately formed components that are joined so as to form the body 110.

As illustrated in FIG. 1, the base portion 114 of the body 110 has a plurality of generally planar faces and an overall rectangular (e.g., slab-like) appearance. The generally planar faces of the base portion 114 include a dispenser-side face, a nozzle-side face, a top face, a bottom face, a proximal face, and a distal face. The dispenser-side face is the surface of the base portion 114 from which the neck portion 112 projects. The nozzle-side face is an opposite surface of the base portion 114 from the dispenser-side face. The top face is the upper surface of the base portion 114 that is between the dispenser-side face and the nozzle-side face. The bottom face (which is hidden from view in FIG. 1 but shown, for instance, in FIG. 3) is the lower surface of the base portion 114 that is opposite from the top face. The proximal face is the surface of the base portion 114 beyond which the neck portion 112 protrudes. The proximal face is also between the dispenser-side face, the top face, the nozzle-side face, and the bottom face. The distal face is an opposite surface of the base portion 114 from the proximal face.

In addition to the fifth port 160, the base portion 114 of the body 110 also defines a first borehole 116, a second borehole 118, and a dispenser-side opening 194. The adapter 100 may be secured to a hot-melt adhesive dispenser via the first borehole 116 and the second borehole 118. For instance, the first borehole 116 and the second borehole 118 may be screw holes configured to receive screws that fasten the adapter 100 to a portion of the housing of the hot-melt adhesive dispenser. The dispenser-side opening 194 is configured to engage with a corresponding portion of the hot-melt adhesive dispenser. In an example embodiment, the dispenser-side opening 194 has a raised, annular rim.

The neck portion 112 of the body 110 projects from the dispenser-side face of the base portion 114. In an example embodiment, the neck portion 112 has an L-like shape with an orthogonal section and a horizontal section. The orthogonal section of the neck portion 112 may form a right angle with the base portion 114. The horizontal section of the neck portion 112 may form a right angle with the orthogonal section while being parallel to the base portion 114. The horizontal section of the neck portion 112 defines the first port 120, the second port 130, and the third port 140 (FIG. 3), while the orthogonal section of the neck portion 112 defines the fourth port 150.

Figure 2:
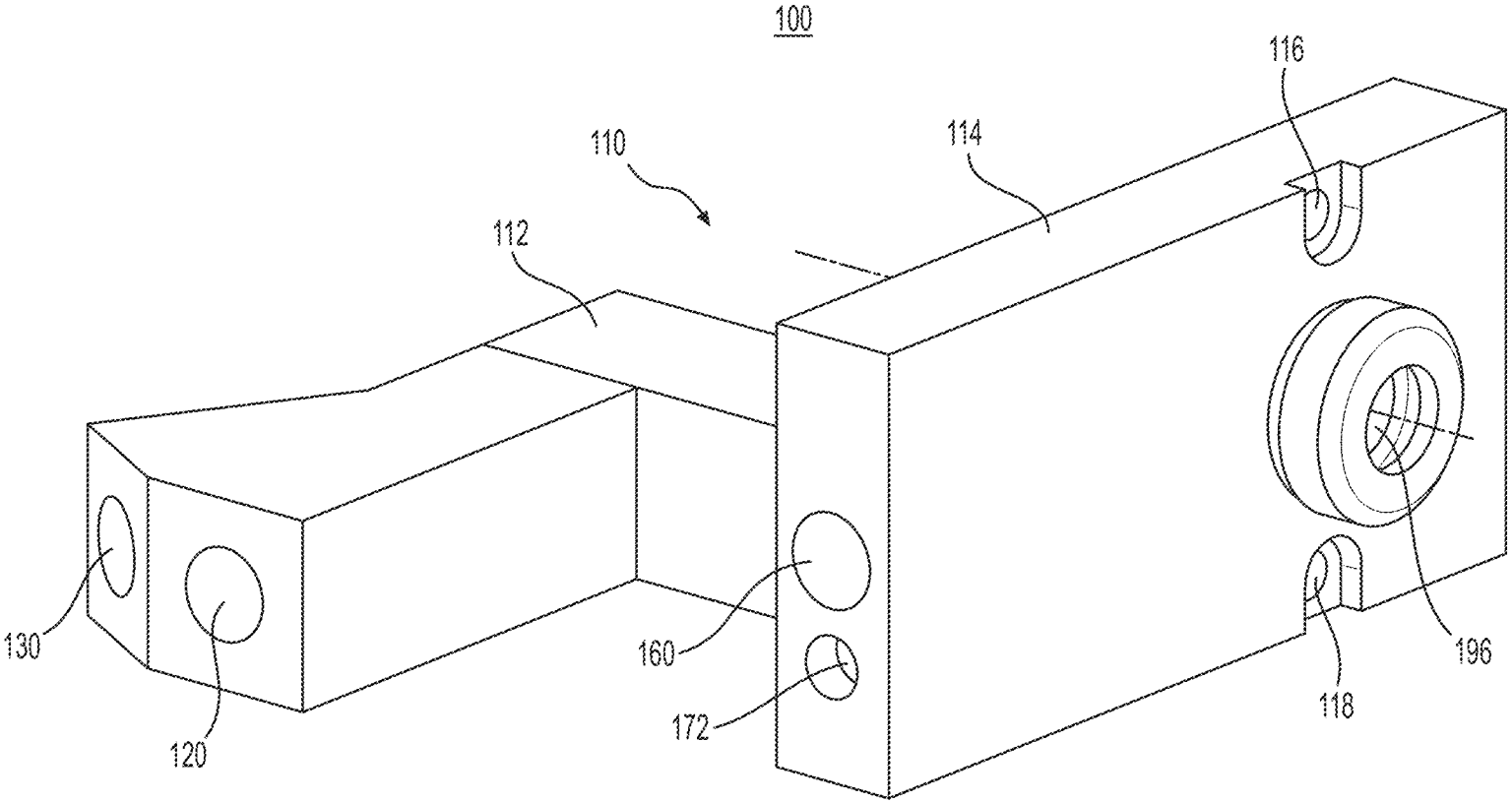
FIG. 2 is an upper proximal, nozzle-side perspective view of the adapter of FIG. 1.

FIG. 2 is an upper proximal, nozzle-side perspective view of the adapter of FIG. 1. Referring to FIG. 2, the base portion 114 also defines a heating channel 172 and a nozzle-side opening 196. The heating channel 172 is configured to receive a heating element which, during the operation of the hot-melt adhesive dispenser, heats the adapter 100 (e.g., via conduction) and the hot-melt adhesive passing therethrough. In an example embodiment, the heating channel 172 extends completely through the base portion 114 from the proximal face to the opposing distal face.

The nozzle-side opening 196 shown in FIG. 2 is in fluidic communication with the dispenser-side opening 194 shown in FIG. 1. In an example embodiment, the nozzle-side opening 196 is connected to the dispenser-side opening 194 via a constricted opening defined by the base portion 114, wherein the constricted opening has a smaller diameter than the nozzle-side opening 196 and the dispenser-side opening 194. The nozzle-side opening 196 may have a raised, annular rim with beveled outer edges. The nozzle-side opening 196 is configured to engage with a nozzle, which will be subsequently discussed herein.

Additionally, as illustrated in FIG. 2, the area around the first borehole 116 and adjacent to the top face of the base portion 114 may be recessed. Similarly, the area around the second borehole 118 and adjacent to the bottom face (which is hidden from view in FIG. 2 but shown, for instance, in FIG. 3) of the base portion 114 may be recessed. As a result, when screws are used to fasten the adapter 100 to a portion of the housing of the hot-melt adhesive dispenser, the head of each of the screws may be seated within a recessed area corresponding to each of the first borehole 116 and the second borehole 118. The depth of the recessed areas may be such that the heads of the screws (when fully seated therein) will be substantially flush with or slightly below the adjacent surface of the nozzle-side face of the base portion 114.

Figure 3:
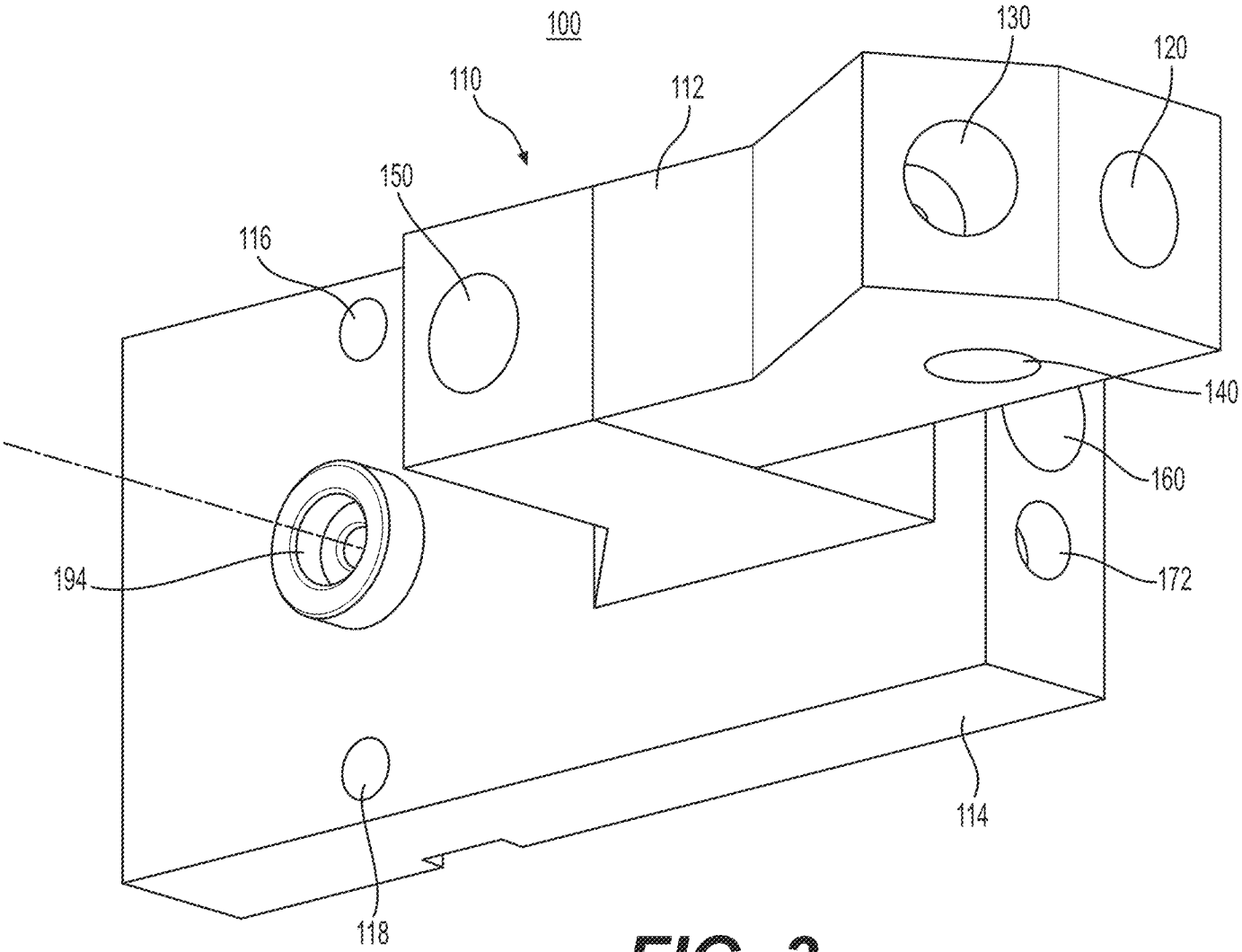
FIG. 3 is a lower proximal, dispenser-side perspective view of the adapter of FIG. 1.

FIG. 3 is a lower proximal, dispenser-side perspective view of the adapter of FIG. 1. Referring to FIG. 3, the third port 140 mentioned supra is shown in the underside of the horizontal section of the neck portion 112. The third port 140 extends into the horizontal section of the neck portion 112 such that the terminus of the third port 140 coincides with, overlaps, or is otherwise fluidically-adjacent to the terminus of the first port 120. As a result, the first port 120 and/or the third port 140 may be used as an entrance (or access point) to the first inlet channel 122 (FIGS. 11-12). Thus, a hot-melt adhesive may be supplied to the first inlet channel 122 (FIGS. 11-12) of the adapter 100 via the first port 120 and/or the third port 140. The diameters of the first port 120, the second port 130, the third port 140, the fourth port 150, and the fifth port 160 may be the same, although example embodiments are not limited thereto.

Figure 4:
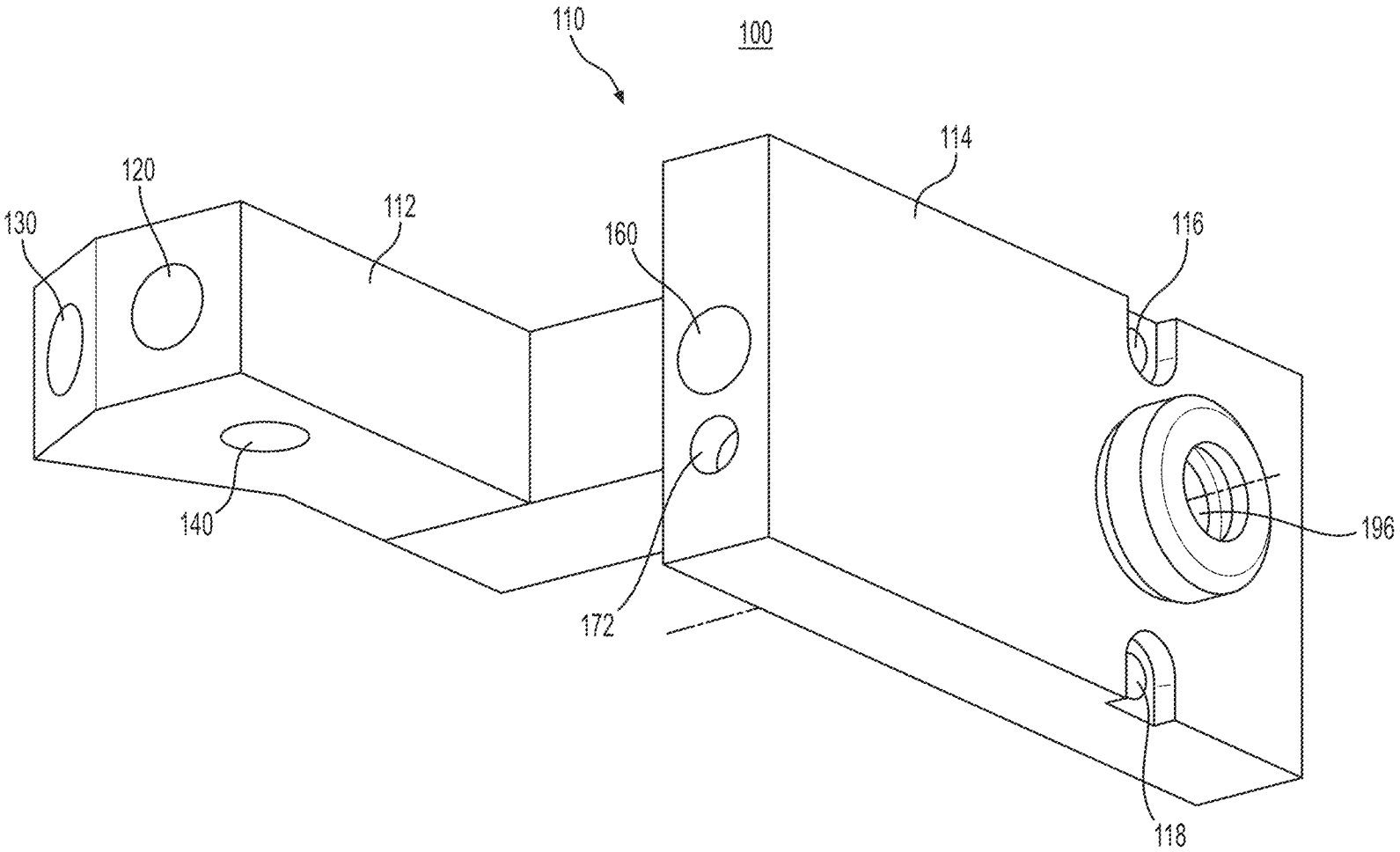
FIG. 4 is a lower proximal, nozzle-side perspective view of the adapter of FIG. 1.

FIG. 4 is a lower proximal, nozzle-side perspective view of the adapter of FIG. 1. Referring to FIG. 4, the heating channel 172 extends completely through the base portion 114 from the proximal face to the opposing distal face. In an example embodiment, the heating channel 172 is situated between the nozzle-side opening 196 and the second borehole 118. The heating channel 172 is isolated from the first port 120, the second port 130, the third port 140, the fourth port 150, and the fifth port 160. As a result, a hot-melt adhesive that is supplied to the adapter 100 via the first port 120, the second port 130, the third port 140, the fourth port 150, and/or the fifth port 160 will flow through the body 110 to the nozzle-side opening 196 without entering or passing through the heating channel 172.

Figure 5:
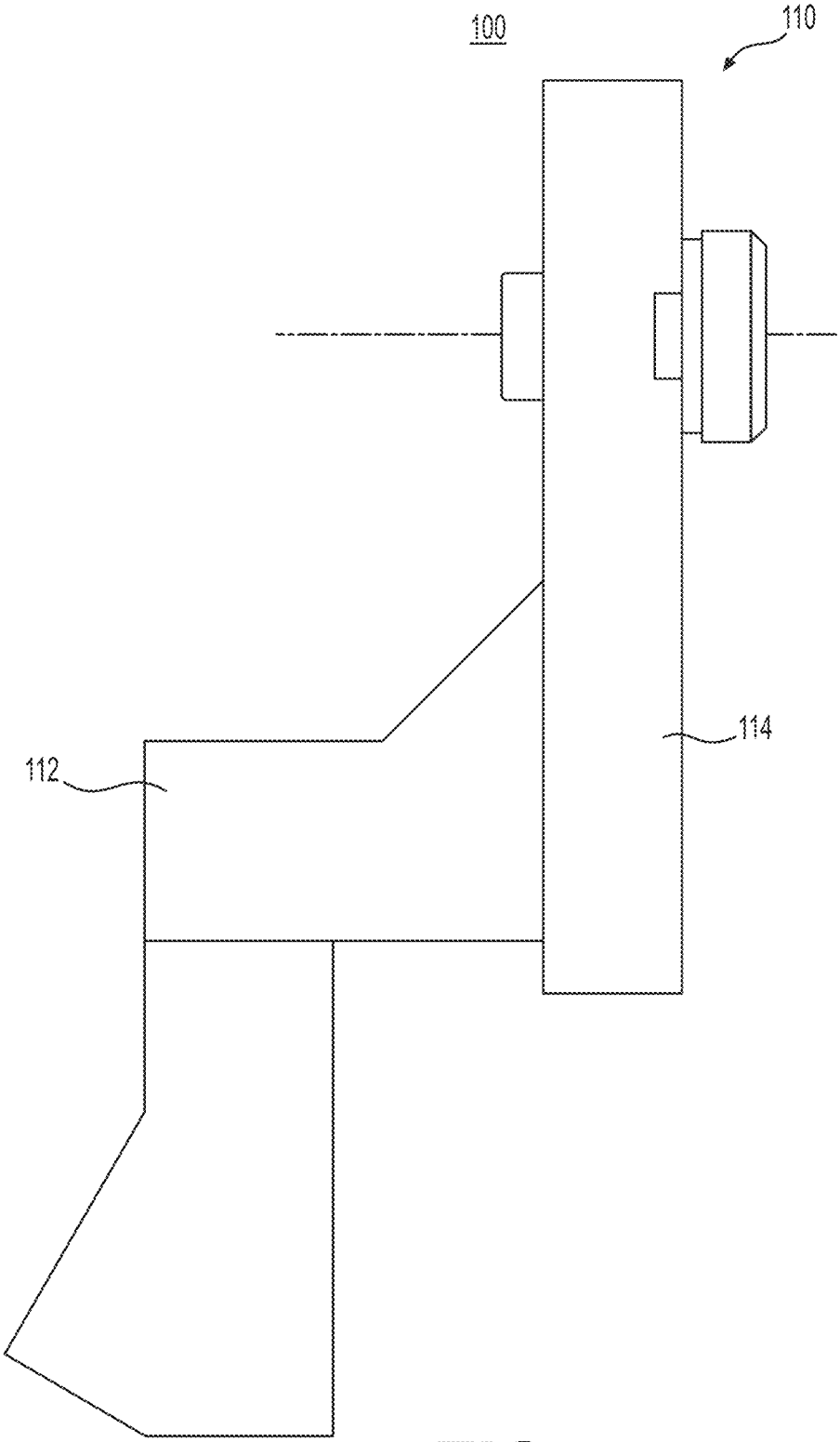
FIG. 5 is a top view of the adapter of FIG. 1.

FIG. 5 is a top view of the adapter of FIG. 1. Referring to FIG. 5 and as noted supra, the body 110 of the adapter 100 may be regarded as having a neck portion 112 and a base portion 114. The neck portion 112 projects from the dispenser-side face of the base portion 114. The neck portion 112 may be positioned so as to be closer to the proximal face of the base portion 114 than the opposing distal face, although example embodiments are not limited thereto. In addition, the orthogonal section of the neck portion 112 may be spaced apart from the proximal face of the base portion 114. However, in some instances, the dimensions and/or position of the neck portion 112 may be such that the proximal surface of the orthogonal section is flush with the proximal face of the base portion 114. Furthermore, the orthogonal section of the neck portion 112 may have an enlarged base with an inclined surface that abuts the base portion 114. Alternatively, in lieu of the inclined surface, the orthogonal section of the neck portion 112 may include just orthogonal surfaces so as to have a constant cross-section (e.g., square cross-section) from the segment adjacent to the base portion 114 to the segment adjacent to the horizontal section of the neck portion 112.

Figure 6:
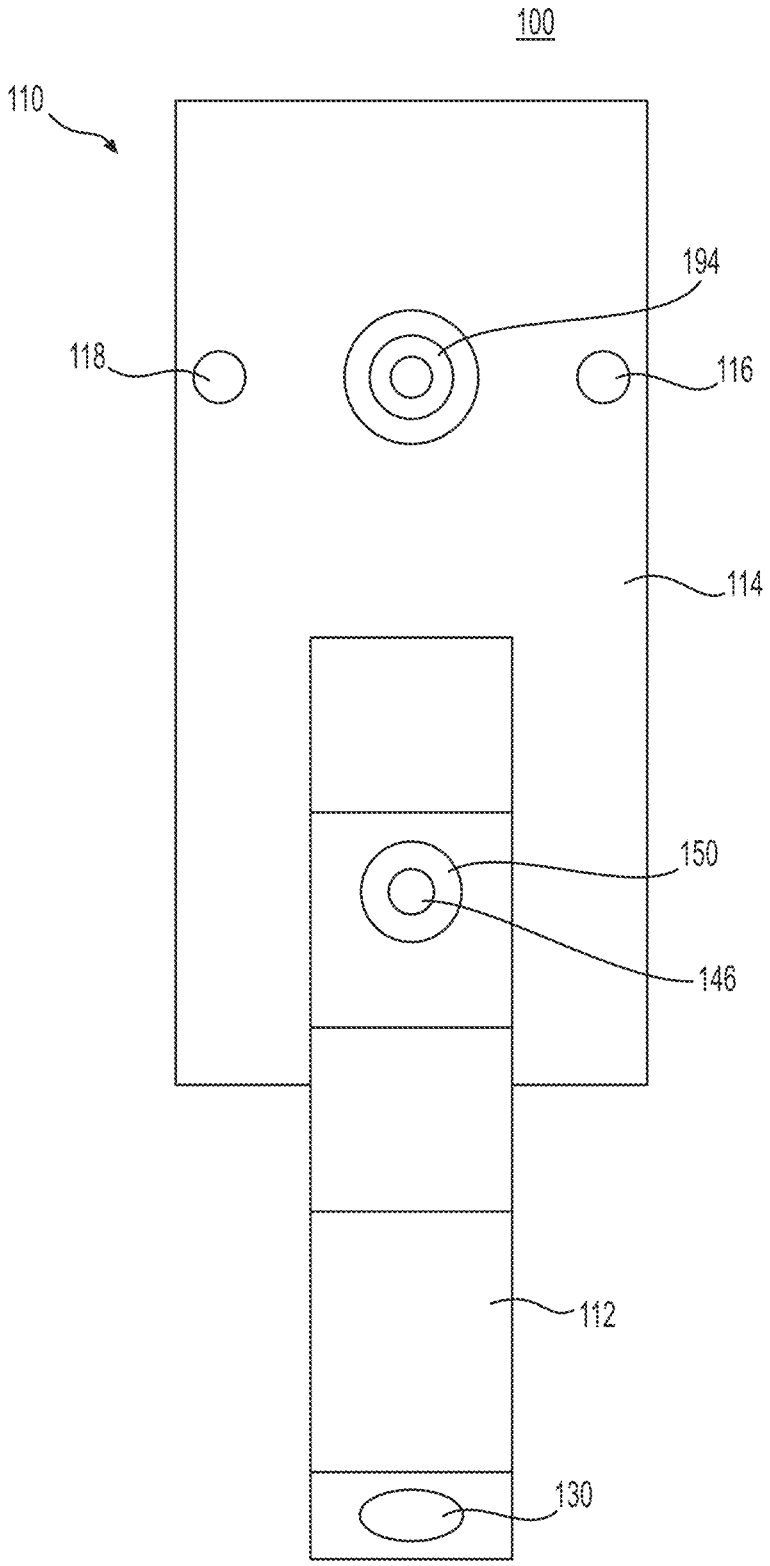
FIG. 6 is a dispenser-side view of the adapter of FIG. 1.

FIG. 6 is a dispenser-side view of the adapter of FIG. 1. Referring to FIG. 6, the neck portion 112 of the body 110 may be positioned equidistantly between the top face and the opposing bottom face of the base portion 114 (which, as illustrated in FIG. 6, is the right side and the left side, respectively, of the base portion 114), although example embodiments are not limited thereto. The fourth port 150 is an entrance (or access point) to the second feed segment 146 of the feed channel 142 (which will be discussed in more detail in connection with FIGS. 11-12). When the adapter 100 is in use with a hot-melt adhesive dispenser, the fourth port 150 may be plugged (without plugging the second feed segment 146 of the feed channel 142).

Figure 7:
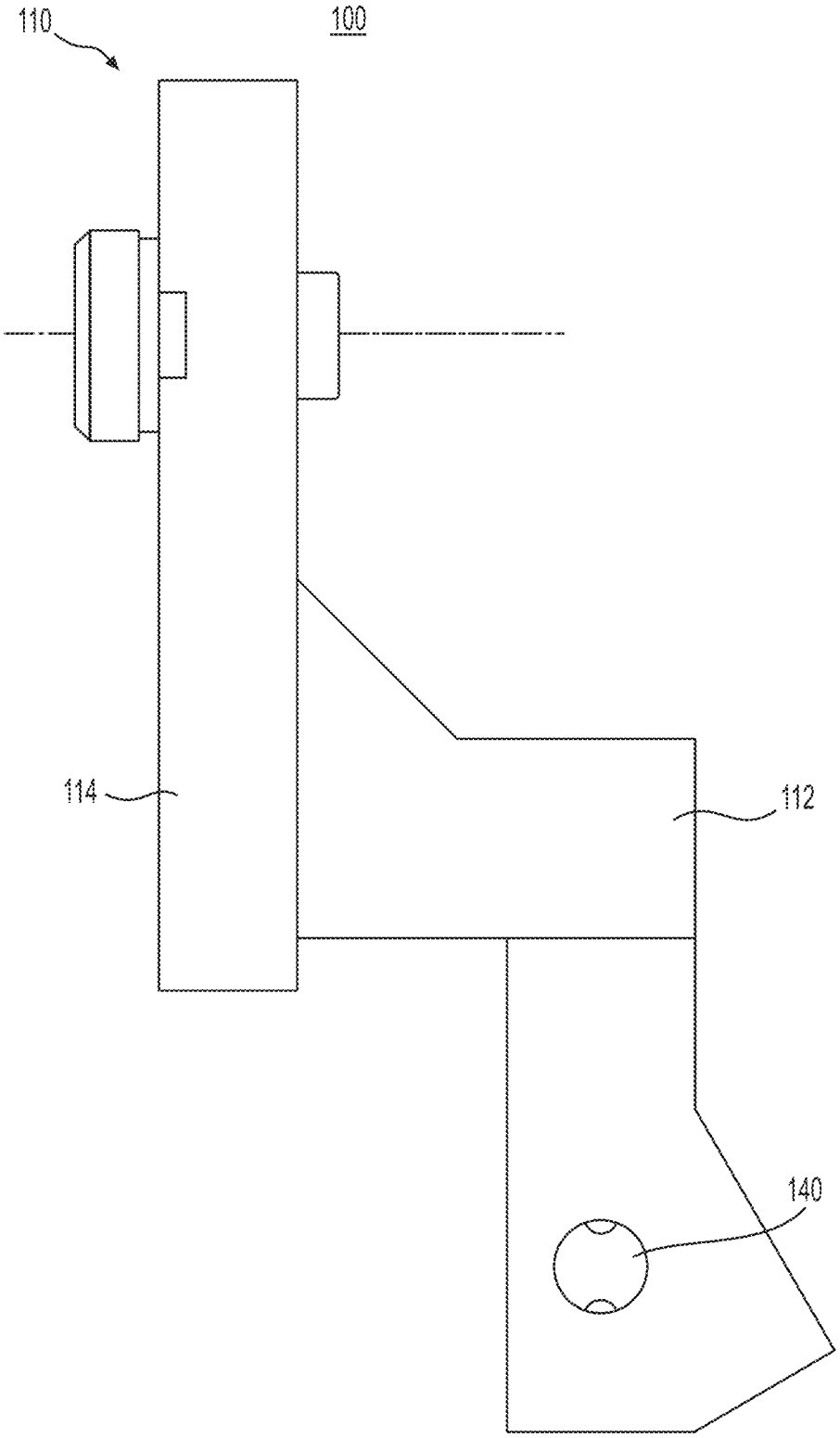
FIG. 7 is a bottom view of the adapter of FIG. 1.

FIG. 7 is a bottom view of the adapter of FIG. 1. Referring to FIG. 7, the neck portion 112 of the body 110 projects from the dispenser-side face of the base portion 114 and protrudes laterally beyond the proximal face of the base portion 114 via its horizontal section (which may be parallel to the base portion 114). The third port 140 extends into the horizontal section of the neck portion 112 and is connected to the first inlet channel 122 (which will be discussed in more detail in connection with FIGS. 11-12). The first port 120 is also connected to the first inlet channel 122 and may be regarded as being upstream from the third port 140. In an example embodiment, the third port 140 may be used as an alternative to the first port 120 with regard to supplying a hot-melt adhesive to the first inlet channel 122. As used herein, "upstream" (and, conversely, "downstream") is in relation to a flow of the hot-melt adhesive.

Figure 8:
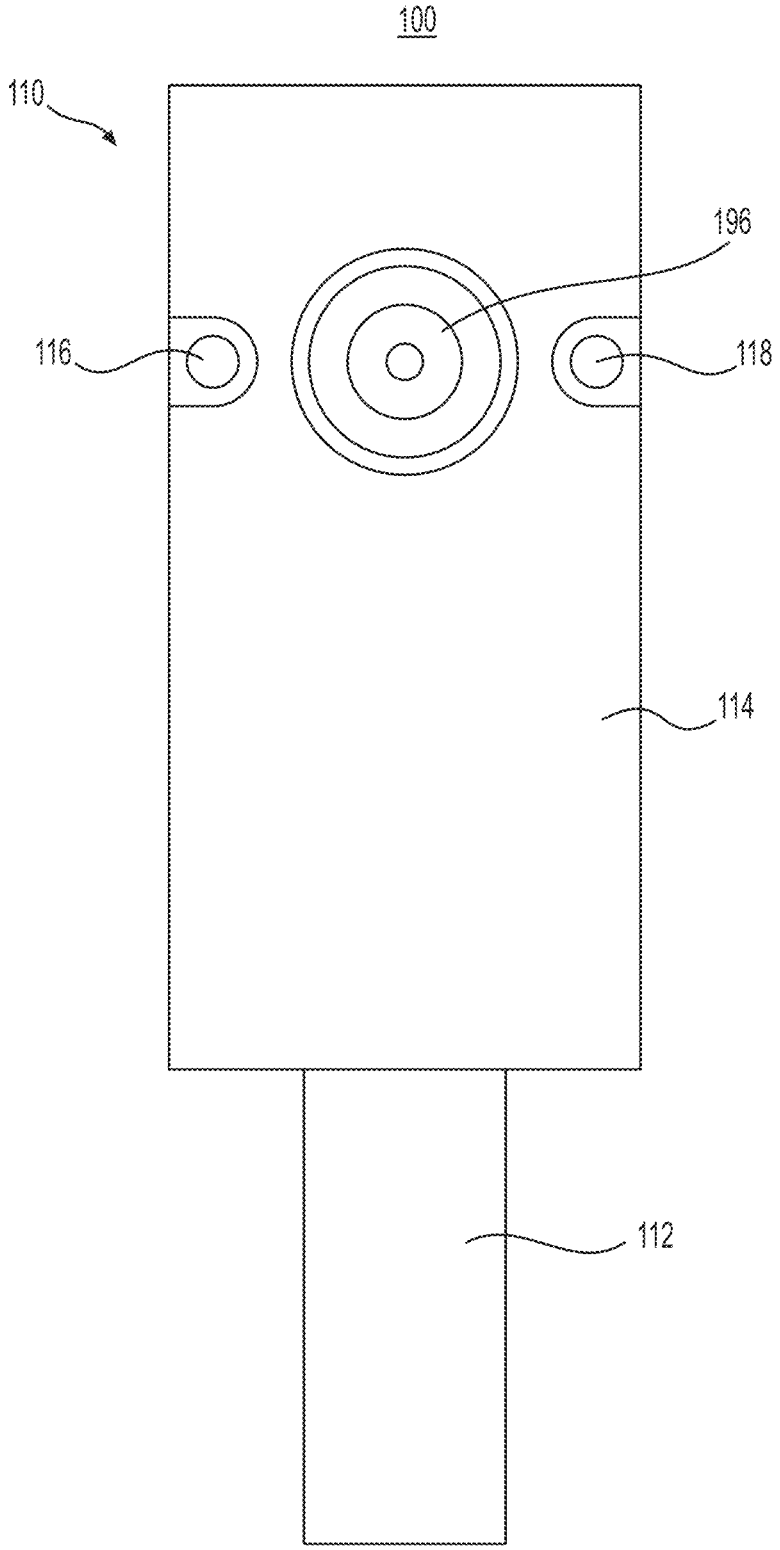
FIG. 8 is a nozzle-side view of the adapter of FIG. 1.

FIG. 8 is a nozzle-side view of the adapter of FIG. 1. Referring to FIG. 8, the orthogonal section of the neck portion 112 is hidden from view by the base portion 114, while the segment of the horizontal section of the neck portion 112 that protrudes beyond the proximal face of the base portion 114 is visible. In addition, the segment of the horizontal section of the neck portion 112 that protrudes beyond the proximal face of the base portion 114 is less than a longest dimension (e.g., length) of the base portion 114, although example embodiments are not limited thereto. Stated differently, the base portion 114 may make up a majority of the overall longest dimension (e.g., length) of the adapter 100 shown in FIG. 8. The nozzle-side opening 196 is in fluidic communication with the dispenser-side opening 194 via a constricted opening therebetween. Furthermore, the recessed area around each of the first borehole 116 and the second borehole 118 may have a shape resembling a rectangle with a semicircular end (e.g., elongated semicircle, semi-obround), but it should be understood that other configurations may also be employed. The first borehole 116 and the second borehole 118 may also be aligned with the nozzle-side opening 196 (and the dispenser-side opening 194). For instance, the center of each of the first borehole 116 and the second borehole 118 may be linearly-aligned with the center of the nozzle-side opening 196 (and the dispenser-side opening 194).

Figure 9:
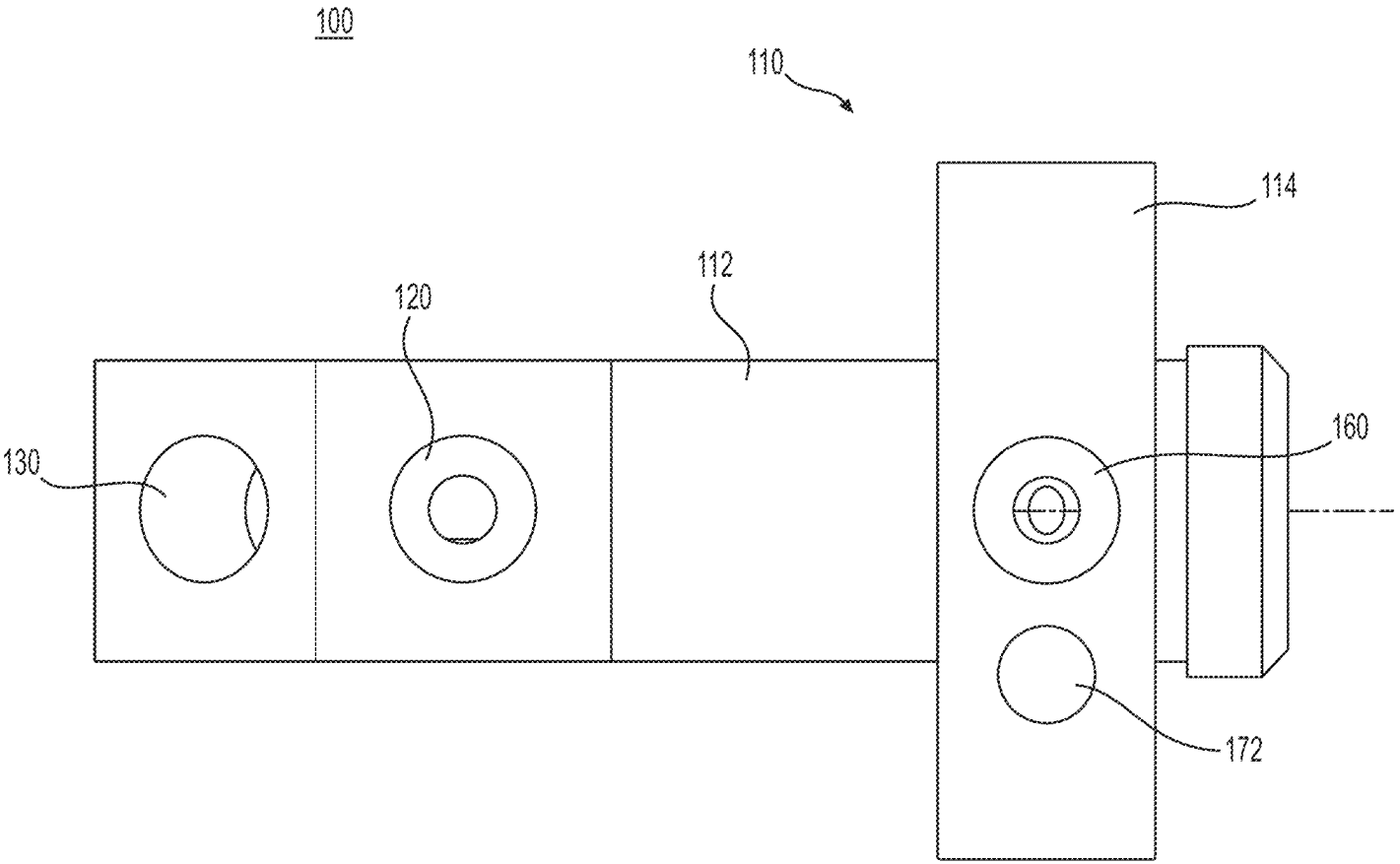
FIG. 9 is a proximal end view of the adapter of FIG. 1.

FIG. 9 is a proximal end view of the adapter of FIG. 1. Referring to FIG. 9, the first port 120 and the second port 130 are oriented at an angle relative to each other such that the corresponding first inlet channel 122 and second inlet channel 132, respectively, converge and merge within the neck portion 112 of the body 110 to form the feed channel 142 (FIGS. 11-12). The fifth port 160 is an entrance (or access point) to the third feed segment 148 of the feed channel 142 (FIGS. 11-12). When the adapter 100 is in use with a hot-melt adhesive dispenser, the fifth port 160 may be plugged (without plugging the third feed segment 148 of the feed channel 142). In addition, one of the first port 120 or the second port 130 may be plugged depending on the configuration of the hot-melt adhesive dispensing system. The heating channel 172 extends through the base portion 114 from the proximal face (shown in FIG. 9) to the opposing distal face (shown in FIG. 10). With regard to dimensions of the heating channel 172, the opening in the proximal face of the base portion 114 may be smaller than the opening in the distal face of the base portion 114, although example embodiments are not limited thereto.

Figure 10:
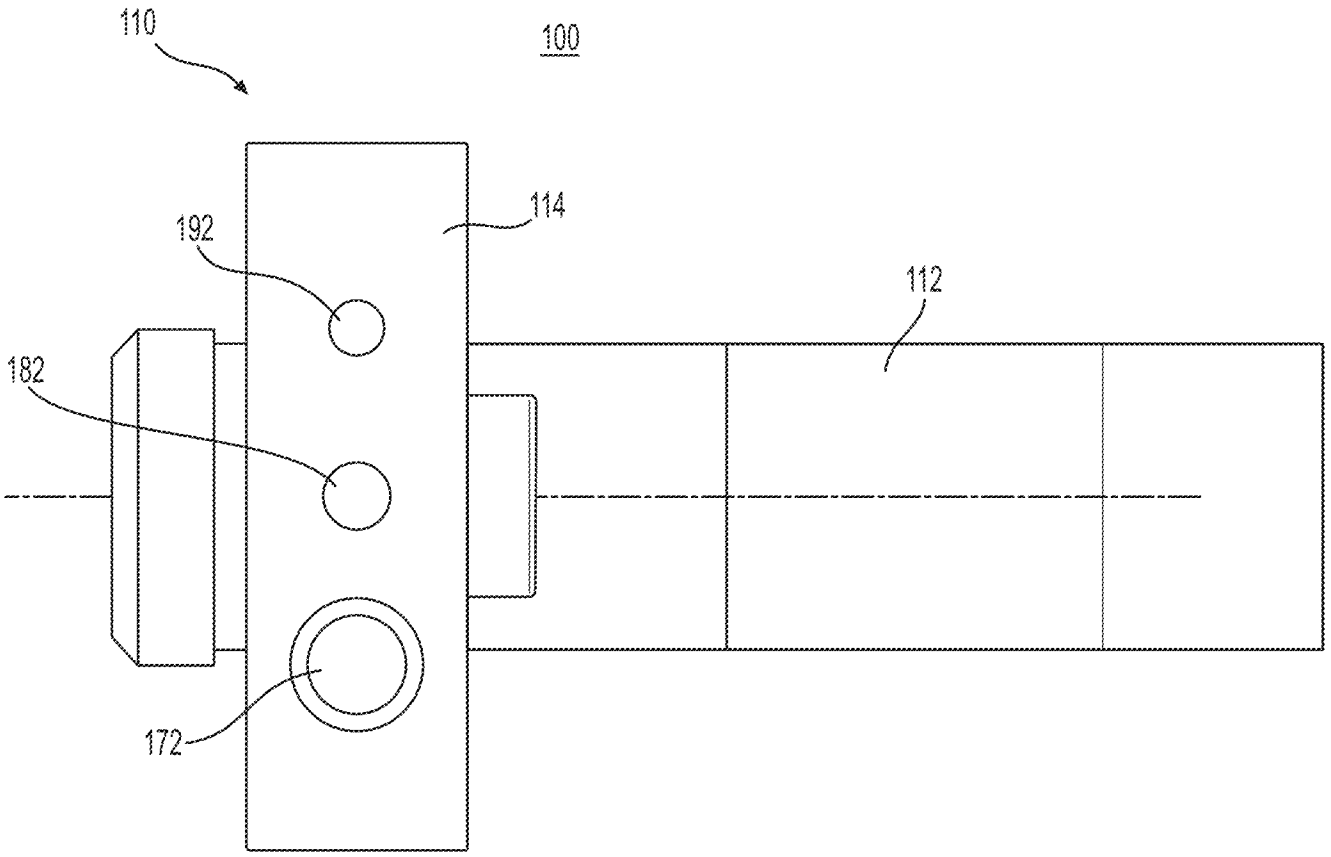
FIG. 10 is a distal end view of the adapter of FIG. 1.

FIG. 10 is a distal end view of the adapter of FIG. 1. In addition to the heating channel 172 shown in FIG. 10, the base portion 114 of the body 110 also defines a thermocouple channel 182 and a grounding channel 192. In an example embodiment, the heating channel 172 is a through hole, while the thermocouple channel 182 and the grounding channel 192 are blind holes. The thermocouple channel 182 is configured to receive a thermocouple in connection with the measurement and control of the temperature of the adapter 100 (e.g., via the control of the heating element in the heating channel 172). The grounding channel 192 is configured to accommodate a grounding wire, which is a safety wire that is connected to earth and that does not carry electricity under normal conditions.

FIG. 11 is a dispenser-side transparent view of the adapter of FIG. 1. FIG. 12 is a nozzle-side transparent view of the adapter of FIG. 1. Referring to FIGS. 11-12, the adapter 100 includes a body 110 defining a plurality of internal channels, including a first inlet channel 122, a second inlet channel 132, and a feed channel 142. The first inlet channel 122 is configured to receive a first adhesive. The second inlet channel 132 is configured to receive a second adhesive. The feed channel 142 is configured to feed (e.g., direct) at least one of the first adhesive or the second adhesive to the hot-melt adhesive dispenser.

The feed channel 142 includes a first feed segment 144, a second feed segment 146, and a third feed segment 148. The first feed segment 144 of the feed channel 142 is downstream from the first inlet channel 122 and the second inlet channel 132. The first inlet channel 122, the second inlet channel 132, and the first feed segment 144 of the feed channel 142 may have a form resembling a two-prong fork or a y-shape. As a result, the proximal end of the neck portion 112 may be flared or otherwise enlarged to accommodate the angled orientations of the first inlet channel 122 and the second inlet channel 132. The first feed segment 144 of the feed channel 142 may be parallel to the third feed segment 148, although example embodiments are not limited thereto. The second feed segment 146 of the feed channel 142 is between the first feed segment 144 and the third feed segment 148. The second feed segment 146 of the feed channel 142 may be orthogonal to the first feed segment 144 and the third feed segment 148. Alternatively, the second feed segment 146 of the feed channel 142 may form acute angles or obtuse angles (as opposed to right angles) with the first feed segment 144 and the third feed segment 148.

In an example embodiment, the first feed segment 144 of the feed channel 142 has a length between 1.2 and 2.4 inches. In addition, the first feed segment 144 of the feed channel 142 may have a diameter between 0.1 and 0.2 inches. In another example embodiment, the second feed segment 146 of the feed channel 142 has a length between 0.8 and 1.6 inches. Additionally, the second feed segment 146 of the feed channel 142 may have a diameter between 0.1 and 0.2 inches. In a further example embodiment, the third feed segment 148 of the feed channel 142 has a length between 1.2 and 2.4 inches. Furthermore, the third feed segment 148 of the feed channel 142 may have a diameter between 0.1 and 0.2 inches.

As illustrated in FIGS. 11-12, the first feed segment 144 of the feed channel 142 may be shorter than the second feed segment 146, and the second feed segment 146 may be shorter than the third feed segment 148. The diameters of the first feed segment 144, the second feed segment 146, and the third feed segment 148 may be the same. In addition, the average diameter of each of the first feed segment 144, the second feed segment 146, and the third feed segment 148 may be larger than the average diameter of the grounding channel 192 and smaller than the average diameter of the heating channel 172.

The thermocouple channel 182 may be aligned with the third feed segment 148 of the feed channel 142. For instance, the longitudinal axis of the thermocouple channel 182 may coincide with the longitudinal axis of the third feed segment 148 of the feed channel 142. The diameter of the thermocouple channel 182 may also be the same as the diameter of the third feed segment 148 of the feed channel 142. Furthermore, the thermocouple channel 182 is a blind hole and, thus, not connected to the dispenser-side opening 194, the nozzle-side opening 196, or the third feed segment 148 of the feed channel 142.

The grounding channel 192, the thermocouple channel 182, and the heating channel 172 may be parallel to each other, although example embodiments are not limited thereto. Additionally, the longitudinal axes of the grounding channel 192, the thermocouple channel 182, and the heating channel 172 may be on the same plane. The thermocouple channel 182 may be longer than the grounding channel 192 (which is also a blind hole) and shorter than the heating channel 172 (which is a through hole). The diameter of the thermocouple channel 182 may be greater than the diameter of the grounding channel 192 and less than the diameter of the heating channel 172.

As noted supra, the neck portion 112 of the body 110 extends from the base portion 114. The neck portion 112 of the body 110 defines the first inlet channel 122, the second inlet channel 132, and an initial segment of the feed channel 142. The initial segment of the feed channel 142 may include the first feed segment 144 and a majority fraction of the second feed segment 146. The base portion 114 of the body 110 defines a remaining segment of the feed channel 142. The remaining segment of the feed channel 142 includes the third feed segment 148 and a minority fraction of the second feed segment 146. The base portion 114 may further define the heating channel 172 so as to be adjacent to the remaining segment of the feed channel 142.

The first port 120 is an enlarged entrance to the first inlet channel 122, while the second port 130 is an enlarged entrance to the second inlet channel 132. In addition, the third port 140 is an enlarged and alternative entrance to the first inlet channel 122. The fourth port 150 is an enlarged entrance to the second feed segment 146 of the feed channel 142. Furthermore, the fifth port 160 is an enlarged entrance to the third feed segment 148 of the feed channel 142. Various combinations of the first port 120, the second port 130, the third port 140, the fourth port 150, and/or the fifth port 160 may be utilized to supply one or more hot-melt adhesives to the body 110 of the adapter 100.

In an example embodiment, the third port 140 is between the first port 120 and the first inlet channel 122 such that the first port 120 is connected to a sidewall surface of the third port 140, while the first inlet channel 122 is connected to an opposing sidewall surface of the third port 140. Alternatively, the first inlet channel 122 may be connected directly to the first port 120, and the third port 140 is connected to a segment of the first inlet channel 122 downstream from the first port 120. The second inlet channel 132 is directly connected to the second port 130 and also converges so as to form a junction with the first inlet channel 122. The channel segment immediately following the junction of the first inlet channel 122 and the second inlet channel 132 may be regarded as the beginning of the feed channel 142.

In an example embodiment, the first feed segment 144 of the feed channel 142 is connected to a sidewall surface of the fourth port 150. In such an instance, the first feed segment 144 of the feed channel 142 may be regarded as being connected to the second feed segment 146 via the fourth port 150. Alternatively, the feed channel 142 may be configured such that the first feed segment 144 is connected directly to the second feed segment 146.

In an example embodiment, the second feed segment 146 of the feed channel 142 may be connected directly to the third feed segment 148. Alternatively, the feed channel 142 may be configured such that the second feed segment 146 is connected to a sidewall surface of the fifth port 160. In such an instance, the second feed segment 146 of the feed channel 142 may be regarded as being connected to the third feed segment 148 via the fifth port 160. The third feed segment 148 of the feed channel 142 may be connected to a sidewall surface of the nozzle-side opening 196.

The body 110 of the adapter 100 is configured to heat (e.g., conductively heat) the first inlet channel 122, the second inlet channel 132, and the feed channel 142 such that the first adhesive, the second adhesive, or both remain in a fluidic state while being fed to the hot-melt adhesive dispenser. The desired heating (e.g., conductive heating of the body 110) can be achieved with a heating element that is disposed within the heating channel 172. In addition, the temperature of the body 110 of the adapter 100 may be measured with a thermocouple that is disposed within the thermocouple channel 182. The thermocouple, in turn, may be electrically connected to a controller (e.g., conventional device known in the art) which is configured to regulate the supply of an electric current to the heating element in order to control the temperature of the body 110 of the adapter 100.

Figure 13:
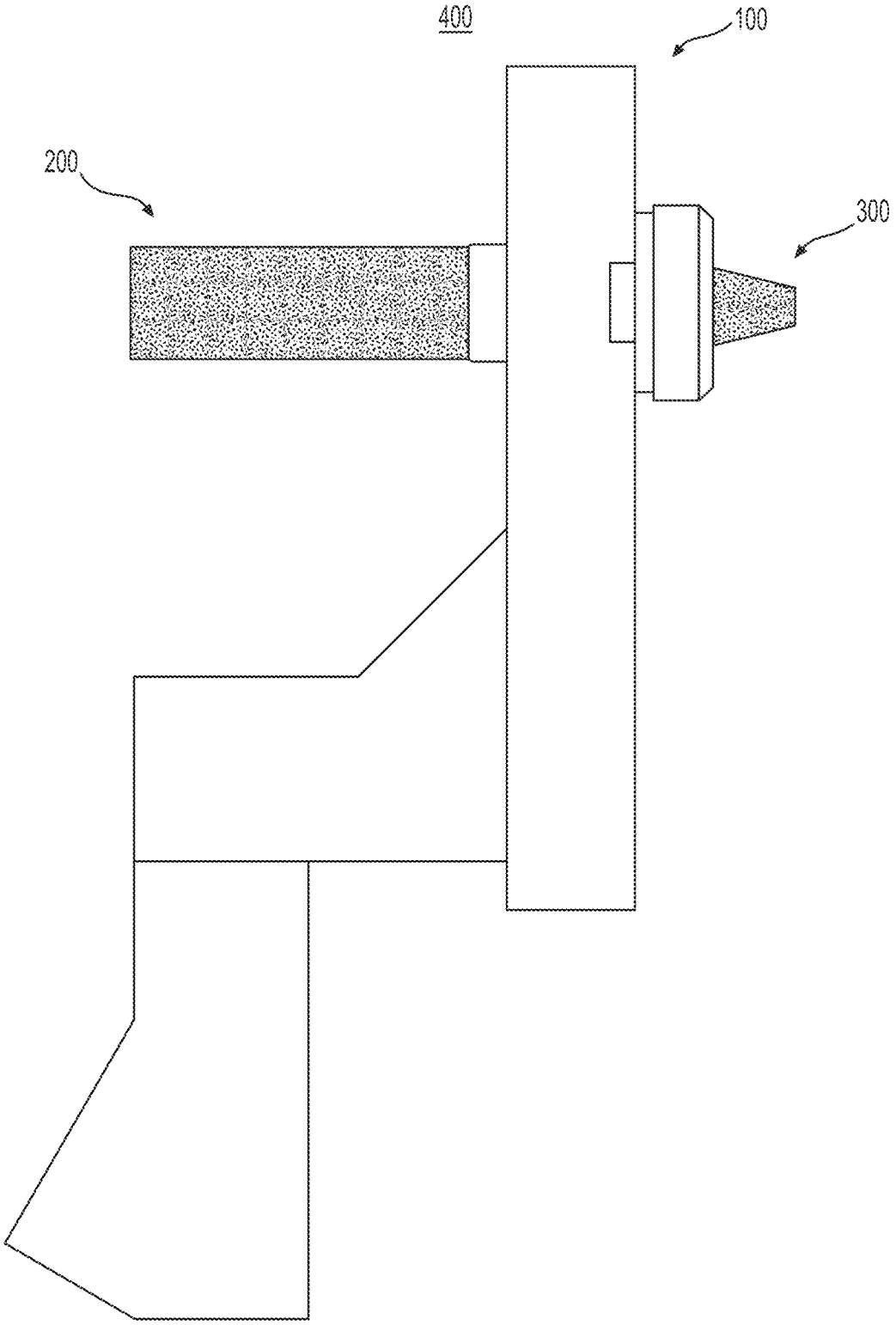
FIG. 13 is a schematic view of a hot-melt adhesive dispensing system according to an example embodiment.

FIG. 13 is a schematic view of a hot-melt adhesive dispensing system according to an example embodiment. Referring to FIG. 13, a hot-melt adhesive dispensing system 400 may include a hot-melt adhesive dispenser 200, an adapter 100, and a nozzle 300. The adapter 100 may be mounted such that a corresponding portion of the hot-melt adhesive dispenser 200 is engaged (e.g., friction-fit via an o-ring) with the dispenser-side opening 194 of the adapter 100. A nozzle 300 may be engaged (e.g., threaded engagement) with the nozzle-side opening 196 of the adapter 100. In FIG. 13, it should be understood that the hot-melt adhesive dispenser 200 is schematically shown. For instance, the hot-melt adhesive dispenser 200 may define an adhesive inlet, an adhesive chamber, and an adhesive outlet. The hot-melt adhesive dispenser 200 may also include a heater configured to heat the adhesive chamber.

During the setup and operation of the hot-melt adhesive dispensing system 400, one or more adhesive supply lines may be connected to the adapter 100 via various combinations of the first port 120, the second port 130, the third port 140, the fourth port 150, and/or the fifth port 160. In an example embodiment, one adhesive supply line may be connected to the second port 130, and another adhesive supply line may be connected to the third port 140, while the first port 120, the fourth port 150, and the fifth port 160 are plugged. However, it should be understood that other combinations are possible. In particular, when space permits (e.g., based on existing equipment), more than two adhesive supply lines (e.g., three, four, or five) may be connected to various combinations of the first port 120, the second port 130, the third port 140, the fourth port 150, and/or the fifth port 160.

When a plurality of adhesives are set up for dispensing, the hot-melt adhesive dispensing system 400 may be configured such that one adhesive is supplied at a time through the adapter 100 to the hot-melt adhesive dispenser 200 and the nozzle 300. The adhesives may be supplied to the adapter 100 from a plurality of corresponding heated tanks. Initially, the adhesives may be in solid form at room temperature and melted to liquid form in the heated tanks. Each of the melted adhesives may then be fed through a corresponding heated pump and a corresponding heated hose to the adapter 100. In an example embodiment, a first adhesive may be supplied to the second port 130 of the adapter 100, wherein the first adhesive flows through the second inlet channel 132 and the feed channel 142 to the hot-melt adhesive dispenser 200 and exits through the nozzle 300. To switch from the first adhesive to a second adhesive, the supply of the first adhesive may be halted (e.g., by halting the corresponding heated pump) and a purge may be performed with the second adhesive to clear the feed channel 142 of the first adhesive. After the purge, the second adhesive may be supplied to the third port 140 of the adapter 100, wherein the second adhesive flows through the first inlet channel 122 and the feed channel 142 to the hot-melt adhesive dispenser 200 and exits through the nozzle 300.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. An adapter for a hot-melt adhesive dispenser, comprising:

a body defining a first inlet channel, a second inlet channel, and a feed channel, the first inlet channel configured to receive a first adhesive, the second inlet channel configured to receive a second adhesive, the feed channel configured to direct at least one of the first adhesive or the second adhesive to the hot-melt adhesive dispenser, the body including a base portion and a neck portion extending from the base portion, the neck portion defining the first inlet channel, the second inlet channel, and an initial segment of the feed channel, the base portion defining a remaining segment of the feed channel and a heating channel adjacent to the remaining segment of the feed channel.

2. The adapter of claim 1, wherein the body is a monolithic structure.

3. The adapter of claim 1, wherein the body is formed of a conductive material.

4. The adapter of claim 3, wherein the conductive material is brass.

5. The adapter of claim 1, wherein the body is configured to conductively heat the first inlet channel, the second inlet channel, and the feed channel such that the first adhesive, the second adhesive, or both remain in a fluidic state while being fed to the hot-melt adhesive dispenser.

6. The adapter of claim 1, wherein the feed channel includes a first feed segment, a second feed segment, and a third feed segment.

7. The adapter of claim 6, wherein the first feed segment of the feed channel is downstream from the first inlet channel and the second inlet channel.

8. The adapter of claim 6, wherein the first feed segment of the feed channel is parallel to the third feed segment.

9. The adapter of claim 6, wherein the second feed segment of the feed channel is between the first feed segment and the third feed segment.

10. The adapter of claim 6, wherein the second feed segment of the feed channel is orthogonal to the first feed segment and the third feed segment.

11. The adapter of claim 6, wherein the first feed segment of the feed channel has a length between 1.2 and 2.4 inches.

12. The adapter of claim 6, wherein the first feed segment of the feed channel has a diameter between 0.1 and 0.2 inches.

13. The adapter of claim 6, wherein the second feed segment of the feed channel has a length between 0.8 and 1.6 inches.

14. The adapter of claim 6, wherein the second feed segment of the feed channel has a diameter between 0.1 and 0.2 inches.

15. The adapter of claim 6, wherein the third feed segment of the feed channel has a length between 1.2 and 2.4 inches.

16. The adapter of claim 6, wherein the third feed segment of the feed channel has a diameter between 0.1 and 0.2 inches.

17. The adapter of claim 1, wherein the base portion and the neck portion of the body are integrally formed.

18. A hot-melt adhesive dispensing system, comprising:

a hot-melt adhesive dispenser defining an adhesive inlet, an adhesive chamber, and an adhesive outlet, the hot-melt adhesive dispenser including a heater configured to heat the adhesive chamber; and an adapter connected to the hot-melt adhesive dispenser, the adapter including a body defining a first inlet channel, a second inlet channel, and a feed channel, the first inlet channel configured to receive a first adhesive, the second inlet channel configured to receive a second adhesive, the feed channel configured to direct at least one of the first adhesive or the second adhesive to the adhesive inlet of the hot-melt adhesive dispenser, the body including a base portion and a neck portion extending from the base portion, the neck portion defining the first inlet channel, the second inlet channel, and an initial segment of the feed channel, the base portion defining a remaining segment of the feed channel and a heating channel adjacent to the remaining segment of the feed channel.

19. A method of dispensing a hot-melt adhesive, comprising:

mounting an adapter onto a hot-melt adhesive dispenser, the adapter including a body defining a first inlet channel, a second inlet channel, and a feed channel, the first inlet channel configured to receive a first adhesive, the second inlet channel configured to receive a second adhesive, the feed channel configured to direct at least one of the first adhesive or the second adhesive to the hot-melt adhesive dispenser, the body including a base portion and a neck portion extending from the base portion, the neck portion defining the first inlet channel, the second inlet channel, and an initial segment of the feed channel, the base portion defining a remaining segment of the feed channel and a heating channel adjacent to the remaining segment of the feed channel;

supplying the first adhesive or the second adhesive to the hot-melt adhesive dispenser via the adapter; and conductively heating the adapter while the first adhesive or the second adhesive is being directed through the body to the hot-melt adhesive dispenser.

* * * * *